US011495900B2

(12) United States Patent
Fu et al.

(10) Patent No.: US 11,495,900 B2
(45) Date of Patent: Nov. 8, 2022

(54) ELECTRICAL CONNECTOR ADAPTER FOR CONNECTING BETWEEN TWO CIRCUIT BOARD CONNECTORS

(71) Applicants: AVIC JONHON OPTRONIC TECHNOLOGY CO., LTD., Luoyangshi (CN); NOKIA SHANGHAI BELL CO., LTD., Shanghai (CN)

(72) Inventors: Jinhui Fu, Luoyangshi (CN); Xianjun Pan, Shanghai (CN); Junfeng Yuan, Luoyangshi (CN); Lufei Ma, Luoyangshi (CN)

(73) Assignees: AVIC JONHON OPTRONIC TECHNOLOGY CO., LTD., Luoyangshi (CN); NOKIA SHANGHAI BELL CO., LTD., Shanghai (CN)

( * ) Notice: Subject to any disclaimer, the term of this patent is extended or adjusted under 35 U.S.C. 154(b) by 8 days.

(21) Appl. No.: 17/251,165

(22) PCT Filed: Jul. 25, 2019

(86) PCT No.: PCT/CN2019/097709
§ 371 (c)(1),
(2) Date: Dec. 10, 2020

(87) PCT Pub. No.: WO2020/020293
PCT Pub. Date: Jan. 30, 2020

(65) Prior Publication Data

US 2021/0265753 A1 Aug. 26, 2021

(30) Foreign Application Priority Data

Jul. 27, 2018 (CN) ..... 201810847129.4

(51) Int. Cl.
*H01R 12/71* (2011.01)
*H01R 12/70* (2011.01)
(Continued)

(52) U.S. Cl.
CPC ..... *H01R 12/716* (2013.01); *H01R 12/707* (2013.01); *H01R 12/7082* (2013.01);
(Continued)

(58) Field of Classification Search
CPC ..... H01R 12/716; H01R 12/707; H01R 12/7082; H01R 13/6582; H01R 13/6587;
(Continued)

(56) References Cited

U.S. PATENT DOCUMENTS

2006/0160380 A1* 7/2006 Korsunsky ..... H01R 13/6585 439/74
2013/0322016 A1 12/2013 Jones et al.

FOREIGN PATENT DOCUMENTS

CN 2458788 Y 11/2001
CN 1808190 A 7/2006
(Continued)

OTHER PUBLICATIONS

Office Action in CN 201810847129.4 with English Translation; dated Jan. 10, 2020; 14 pgs.
(Continued)

*Primary Examiner* — Abdullah A Riyami
*Assistant Examiner* — Justin M Kratt
(74) *Attorney, Agent, or Firm* — Hauptman Ham, LLP

(57) ABSTRACT

A connector assembly includes an adapter connector and two end-connectors. Each connector includes a high-speed differential area and a low-speed area. The high-speed differential area of each end-connector includes an end differential unit. The high-speed differential area of the adapter connector includes an adapter differential module.
(Continued)

Each end differential unit and a corresponding adapter differential unit include a signal contact and a ground shielding member. The plug-in parts of the two end-connectors, which are adapted with the adapter connector, are the same in structure, and of the end differential unit and the adapter differential unit, one is a male unit and the other is a female unit in corresponding plug-in fit. Due to the fact that the plug-in parts of the two end-connectors are the same in structure, when the end-connectors are plugged into the adapter connector, identification can be saved, and blind plugging operation can be directly performed.

12 Claims, 13 Drawing Sheets

(51) Int. Cl.

| | |
|---|---|
| ***H01R 13/6582*** | (2011.01) |
| ***H01R 13/6587*** | (2011.01) |
| ***H01R 31/06*** | (2006.01) |
| *H01R 13/6586* | (2011.01) |
| *H01R 13/02* | (2006.01) |
| *H01R 12/73* | (2011.01) |
| *H01R 13/648* | (2006.01) |

(52) U.S. Cl.
CPC ..... *H01R 13/6582* (2013.01); *H01R 13/6587* (2013.01); *H01R 31/06* (2013.01); *H01R 12/73* (2013.01); *H01R 13/02* (2013.01); *H01R 13/648* (2013.01); *H01R 13/6586* (2013.01)

(58) Field of Classification Search
CPC ..... H01R 31/06; H01R 12/73; H01R 13/02; H01R 13/648; H01R 13/6586
See application file for complete search history.

(56) References Cited

FOREIGN PATENT DOCUMENTS

| | | | |
|---|---|---|---|
| CN | 1808790 | A | 7/2006 |
| CN | 201466299 | U | 5/2010 |
| CN | 201725982 | U | 1/2011 |
| CN | 102738621 | A | 10/2012 |
| CN | 104300313 | A | 1/2015 |
| CN | 109659722 | A | 4/2019 |
| EP | 0273589 | A1 * | 7/1988 |

OTHER PUBLICATIONS

English Translation of Chinese Application No. 201810847129.4 First Search Report; dated Dec. 26, 2019; 2 pgs.
International Search Report issued in corresponding International Application No. PCT/CN2019/097709; dated Oct. 25, 2019; State Intellectual Property Office of the P.R. China, Beijing, China, 6 pgs.
Written Opinion issued in corresponding International Application No. No. PCT/CN2019/097709; dated Oct. 25, 2019; State Intellectual Property Office of the P.R. China, Beijing, China, 7 pgs.

* cited by examiner

ELECTRICAL CONNECTOR ADAPTER FOR CONNECTING BETWEEN TWO CIRCUIT BOARD CONNECTORS

RELATED APPLICATIONS

The present application is a National Phase of International Application Number PCT/CN2019/097709 filed Jul. 25, 2019 and claims priority to Chinese Application Number 201810847129.4 filed Jul. 27, 2018.

TECHNICAL FIELD

The present invention relates to a connector assembly.

BACKGROUND ART

In view of the development trend of miniaturization and integration of electronic products, more and more connectors can be integrated with high-speed modules and low-frequency modules into hybrid connectors, such as a low-frequency and high-speed differential module type hybrid connector disclosed in the utility model patent with the authorization announcement number: CN 201466299 U, which comprises a housing, a low-frequency module and a high-speed differential module are provided in the housing, and the corresponding welding ends of the low-frequency module and the high-speed differential module are located on the same side of the housing. With the development trend of miniaturization, densification and integration, the application of high-speed differential connectors becomes more and more extensive. Due to the large number of transmission signals, a high-speed differential connector generally comprises a shielding structure for shielding every signal transmission circuit so as to avoid crosstalk between adjacent signal transmission circuits. Existing are many types of high-speed differential connectors. In a common connector, for example, a fully shielded differential connector with the application publication number: CN 104300313 A, differential pairs thereof are arranged in a row, between every two adjacent differential pairs is provided with a ground contact, between every two rows of adjacent differential pairs is provided with a wiring shielding member, and during plugging, the differential pairs and the ground contacts of the connector are in close fit with those of an adapter connector on the same side. This differential connector has a high degree of integration and a wide application range.

At present, when an adapter connector having a corresponding differential pair is in use, both ends of the adapter connector are generally respectively provided by plugging with a corresponding end-connector so as to form a connector assembly, and a corresponding signal is transmitted through an end-connector-adapter connector-end-connector signal adapting mode. In addition, because the plug-in parts of the two end-connectors are often different, it is necessary to identify the corresponding plugging ends of the adapter connector, and blind plugging operation cannot be performed.

SUMMARY OF THE INVENTION

It is an object of the present invention to provide a connector assembly so as to solve the technical problem in the prior art that two end-connectors used in cooperation with an adapter connector require identification and blind plugging operation cannot be performed.

In order to achieve the above object, the technical solution of the connector assembly provided by the present invention is: a connector assembly, comprising an adapter connector and two end-connectors correspondingly plugged into the upper and lower ends of the adapter connector, wherein every connector is provided with a high-speed differential area and a functional area sequentially arranged in the left-right direction; the high-speed differential area of each end-connector is provided with an end differential unit, the high-speed differential area of the adapter connector is provided with an adapter differential module, the two ends of the adapter differential module are respectively provided with an adapter differential unit plugged into the end differential unit of the corresponding end-connector to connect the end differential units on both sides, and the end differential unit of each end-connector and the adapter differential unit of the corresponding end of the adapter connector correspondingly form a differential plug-in group; each end differential unit and the corresponding adapter differential unit respectively comprise a signal contact forming a differential signal pair and a ground shielding member arranged corresponding to the differential signal pair; the plug-in parts of the two end-connectors, which are adapted with the adapter connectors, are the same in structure; furthermore, of the end differential unit and the corresponding adapter differential unit of each differential plug-in group, one is a male unit and the other is a female unit, the plug end of the male unit is correspondingly plugged into the socket end of the corresponding female unit; the ground shielding member and the signal contact at the socket end of each female unit are arranged oppositely at an interval to form a plugging space for plugging the ground shielding member and the signal contact at the plug end of the corresponding male unit; on each female unit, a side surface of the signal contact at the socket end facing the plugging space is provided with a female differential contact portion, and on the corresponding male unit, and the corresponding side surface of the signal contact at the plug end is provided with a male differential contact portion for correspondingly abutting against the female differential contact portion; on each female unit, a side surface of the ground shielding member at the socket end facing the plugging space is provided with a female shielding contact portion, and on the corresponding male unit, the corresponding side surface of the ground shielding member at the plug end is provided with a male shielding contact portion for correspondingly abutting against the female shielding contact portion; the ground shielding member and the signal contact at the socket end of each female unit are arranged opposite to each other in the left-right direction, and the differential contact portions of the signal contacts of the adapter differential units at the two ends of the adapter differential module face the same direction.

The present invention has the advantages that, in the connector assembly provided by the present invention, each female unit laterally clamps the adapted male unit between the signal contact and the ground shielding member to realize signal transmission and ground conduction, so that the corresponding differential unit adapted in the plugging position achieves lateral abutting adaption on both sides, and even during application on occasions with vibration or certain plugging offset, the contact reliability of the plugging position can be ensured and the performance be more reliable. Furthermore, due to the fact that the plug-in parts of the two end-connectors, which are adapted with the adapter connectors, are the same in structure, when the end-connectors are plugged into the adapter connector, identification can be saved, and blind plugging operation can be directly performed and be more convenient.

Further, the two end-connectors are the same in structure and accordingly can be produced with the same type of connectors to reduce product specifications and to save design and assembly costs.

On the basis of any of above-mentioned connector assemblies, each male differential contact portion elastically abuts against the corresponding female differential contact portion, and each male shielding contact portion elastically abuts against the corresponding female shielding contact portion. Therefore, the contact reliability can be ensured by the elastic abutting fit.

Further, each male unit further comprises a unit insulator having an insulating support portion located between the ground shielding member and the signal contact at the plug end, and the ground shielding member and the signal contact at the plug end are disposed on the insulating support portion or provided with a support surface for contacting and supporting the ground shielding member and the signal contact at the plug end. The support for the ground shielding member and the signal contact is formed by the insulating support portion, so that the contact strength of the part corresponding to the female unit can be effectively ensured, and the ground shielding member and the signal contact on the male unit can be more conveniently arranged.

Further, on each male unit, the ground shielding member at the plug end is a U-shaped shielding piece, the corresponding signal contact at the plug end is disposed in the U-shaped shielding piece, the insulating support portion is filled in the inner groove of the U-shaped shielding piece to expose the side surface of the corresponding signal contact facing the notch of the U-shaped shielding piece, and the male differential contact portion is provided on the exposed side surface of the corresponding signal contact. Specifically, the U-shaped shielding piece can be used to form a three-sided shield enclosure for the signal contact, thereby improving the shielding effect on the signal contact.

On the basis of the above-mentioned connector assembly with the contact portion in elastic abutting fit, the adapter differential units at the two ends of the adapter differential module are the male units, the adapter differential module comprises an intermediate differential contact member, the two ends of the differential contact member correspondingly form the signal contacts of the two male units, the adapter differential module further comprises a full shielding sheath which is wrapped in an insulating manner around the periphery of the differential contact member, and two ends of the full shielding sheath are integrally extended to ground shielding pieces to form the ground shielding members of the two male units. Therefore, the full shielding effect in the middle of the adapter differential module can be improved by means of the full shielding sheath.

Further, one end of each end-connector away from the adapter connector is welded with a printed board, the adapter connector is a direct adapter connector, and the two printed boards and the two end-connectors adopt one of the following manners:

(1) both the two end-connectors are straight board end-connectors, and the two printed boards are arranged in parallel;

(2) one of the two end-connectors is a straight board end-connector, the other is a bent board end-connector, and the two printed boards are arranged orthogonally;

(3) both the end-connectors are bent board end-connectors, and the two printed boards are arranged in parallel; and (4) both the end-connectors are bent board end-connectors, and the two printed boards are arranged orthogonally.

The connector assembly described above can be applied to different types of printed boards and end-connectors, thereby being wide in application range.

The technical solution of the connector assembly provided by the present invention is: a connector assembly, comprising an adapter connector and two end-connectors correspondingly plugged into the upper and lower ends of the adapter connector, wherein each connector is provided with a high-speed differential area and a functional area sequentially arranged in the left-right direction; the high-speed differential area of each end-connector is provided with an end differential unit, the high-speed differential area of the adapter connector is provided with an adapter differential module, the two ends of the adapter differential module are respectively provided with an adapter differential unit plugged into the end differential unit of the corresponding end-connector to connect the end differential units on both sides, and the end differential unit of each end-connector and the adapter differential unit of the corresponding end of the adapter connector correspondingly form a differential plug-in group; each end differential unit and the corresponding adapter differential unit respectively comprise a signal contact forming a differential signal pair and a ground shielding member arranged corresponding to the differential signal pair; the plug-in parts of the two end-connectors, which are adapted with the adapter connectors are the same in structure; furthermore, of the end differential unit and the corresponding adapter differential unit of each differential plug-in group, one is a male unit and the other is a female unit, and the plug end of the male unit is correspondingly plugged into the socket end of the corresponding female unit; the ground shielding member and the signal contact at the socket end of each female unit are arranged at oppositely at an interval to form a plugging space for plugging the ground shielding member and the signal contact at the plug end of the corresponding male unit; on each female unit, a side surface of the signal contact at the socket end facing the plugging space is provided with a female differential contact portion, and on the corresponding male unit, the corresponding side surface of the signal contact at the plug end is provided with a male differential contact portion for correspondingly abutting against the female differential contact portion; on each female unit, a side surface of the ground shielding member at the socket end facing the plugging space is provided with a female shielding contact portion, and on the corresponding male unit, the corresponding side surface of the ground shielding member at the plug end is provided with a male shielding contact portion for correspondingly abutting against the female shielding contact portion; the ground shielding member and the signal contact at the socket end of each female unit are arranged in a front-rear direction relative to the left-right direction, and the differential contact portions of the signal contacts at the adapter differential units at the two ends of the adapter differential module face opposite directions.

The present invention has the advantages that, in the connector assembly provided by the present invention, each female unit laterally clamps the adapted male unit between the signal contact and the ground shielding member to realize signal transmission and ground conduction, so that the corresponding differential unit adapted in the plugging position achieves lateral abutting adaption on both sides, and even during application on occasions with vibration or certain plugging offset, the contact reliability of the plugging position can be ensured and the performance be more reliable. Furthermore, due to the fact that the plug-in parts of the two end-connectors, which are adapted with the adapter connectors, are the same in structure, when the end-connectors are plugged into the adapter connector, identification can be saved, and blind plugging operation can be directly performed and be more convenient.

Further, the two end-connectors are the same in structure and accordingly can be produced with the same type of connectors to reduce product specifications and to save design and assembly costs.

On the basis of any of above-mentioned connector assemblies, each male differential contact portion elastically abuts against the corresponding female differential contact portion, and each male shielding contact portion elastically abuts against the corresponding female shielding contact portion. Therefore, the contact reliability can be ensured by the elastic abutting fit.

Further, each male unit further comprises a unit insulator having an insulating support portion located between the ground shielding member and the signal contact at the plug end, the ground shielding member and the signal contact at the plug end are disposed on the insulating support portion or provided with a support surface for contacting and supporting the ground shielding member and the signal contact at the plug end. The support for the ground shielding member and the signal contact is formed by the insulating support portion, so that the contact strength of the part corresponding to the female unit can be effectively ensured, and the ground shielding member and the signal contact on the male unit can be more conveniently arranged.

Further, on the male unit, the ground shielding member at the plug end is a U-shaped shielding piece, the corresponding signal contact at the plug end is disposed in the U-shaped shielding piece, the insulating support portion is filled in the inner groove of the U-shaped shielding piece to expose the side surface of the corresponding signal contact facing the notch of the U-shaped shielding piece, and the male differential contact portion is provided on the exposed side surface of the corresponding signal contact. Specifically, the U-shaped shielding piece may be used to form a three-sided shield enclosure for the signal contact, thereby improving the shielding effect on the signal contact.

On the basis of the above-mentioned connector assembly with the contact portion in elastic abutting fit, the adapter differential units at the two ends of the adapter differential module are the male units, the adapter differential module comprises an intermediate differential contact member, the two ends of the differential contact member correspondingly form the signal contacts of the two male units, the adapter differential module further comprises a full shielding sheath which is wrapped in an insulating manner around the periphery of the differential contact member, and two ends of the full shielding sheath are integrally extended to ground shielding pieces to form the ground shielding members of the two male units. Therefore, the full shielding effect in the middle of the adapter differential module can be improved by means of the full shielding sheath.

Further, one end of each end-connector away from the adapter connector is welded with a printed board, the adapter connector is a direct adapter connector, and the two printed boards and the two end-connectors adopt one of the following manners:

(5) both the two end-connectors are straight board end-connectors, and the two printed boards are arranged in parallel;

(6) one of the two end-connectors is a straight board end-connector, the other is a bent board end-connector, and the two printed boards are arranged orthogonally;

(7) both the two end-connectors are bent board end-connectors, and the two printed boards are arranged in parallel; and (8) both the two end-connectors are bent board end-connectors, and the two printed boards are arranged orthogonally.

The connector assembly described above can be applied to different types of printed boards and end-connectors, thereby being wide in application range.

DESCRIPTION OF EMBODIMENTS

Figure 1:
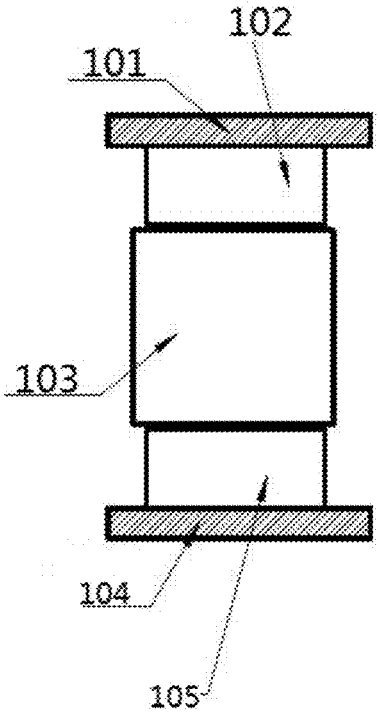
FIG. 1 is a schematic diagram of plugging of an adapter connector and two end-connectors in Embodiment 1 of the connector assembly provided by the present invention.
Figure 2:
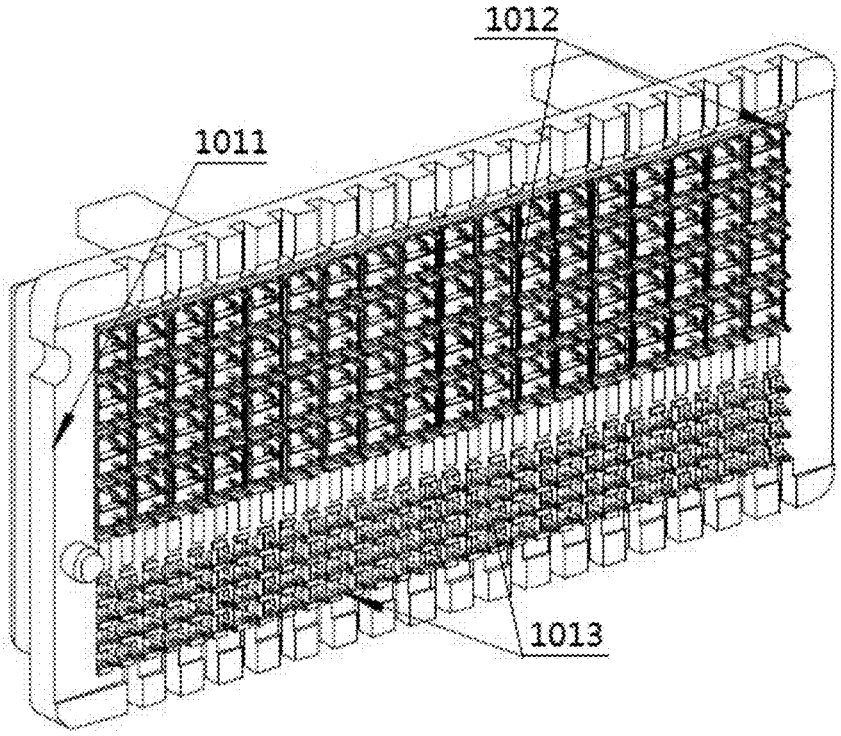
FIG. 2 is a schematic structural view of the end-connector of FIG. 1.

The embodiments of the present invention will be further described below with reference to the accompanying drawings, but are not limited thereto.

Embodiment 1 of the connector assembly provided by the present invention is:

As shown in FIG. 1 to FIG. 6, the connector assembly in this embodiment is a hybrid connector assembly, which specifically includes an adapter connector 103 and two end-connectors, wherein the adapter connector is a straight adapter connector, the two end-connectors are a first straight board end-connector 102 and a second straight board end-connector 105, and the ends of the two straight board end-connectors, which are far away from each other, are correspondingly fixedly connected to printed boards, namely a first printed board 101 and a second printed board 104, respectively.

The above-described two end-connectors are completely the same in structure and are in plugging fit with the upper and lower ends of the adapter connector, and each connector is provided with a high-speed differential area and a functional area which are sequentially arranged in the left-right direction, wherein the functional area specifically is a low-speed and power supply functional area. In other embodiments, the functional area can be other functional structures such as a sole low-speed functional area or a sole power supply functional area.

The adapter connector and the two end-connectors are both in a rectangular structure, the left-right direction thereof corresponds to the width direction of the rectangular structure, and correspondingly, the front-rear direction perpendicular to the left-right direction corresponds to the length direction of the rectangular structure. Specific reference can be made to the end-connector shown in FIG. 2, in which the end-connector comprises an insulating housing 1011, a high-speed differential area and a low-speed and power supply area are sequentially arranged on the insulating housing in the left-right direction, the high-speed differential area is provided with an end differential unit 1012 for transmitting a high-speed differential signal, and the low-speed and power supply area is provided with a low-speed and power supply signal module 1013.

Figure 3:
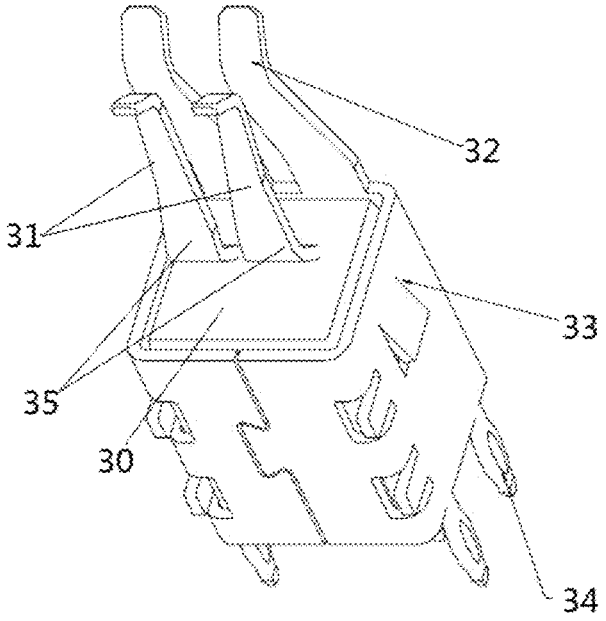
FIG. 3 is a schematic structural view of an end differential unit in FIG. 2.

As for the end-connectors, the high-speed differential area of each end-connector is provided with an end differential unit shown in FIG. 3. The high-speed differential area of the adapter connector is provided with a plurality of adapter differential modules, of which the structure is shown as FIG. 6, two ends of every adapter differential module are respectively provided with an adapter differential unit in plugging fit with the end differential unit of the end-connector on the corresponding side, and the end differential unit of each end-connector and the adapter differential unit of the corresponding end of the adapter connector correspondingly form a differential plug-in group. In practice, both the end differential units and the adapter differential units respectively include a signal contact forming a differential signal pair and a ground shielding member disposed corresponding to the differential signal pair.

Figure 6:
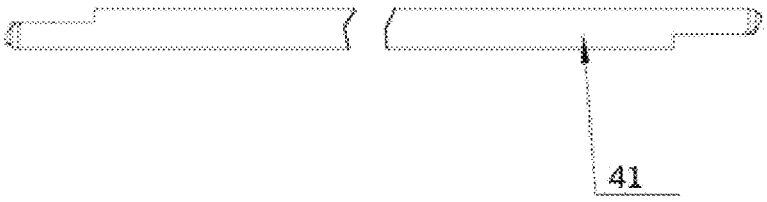
FIG. 6 is a schematic structural diagram of the adapter differential module of the adapter connector in FIG. 1.

In the embodiment, the end differential units shown in FIG. 3 are female units, the adapter differential units at the two ends of the adapter differential module shown in FIG. 6 are male units, and the male units and the female units are correspondingly matched, so that the end differential unit and the corresponding adapter differential unit of each differential plug-in group can be correspondingly plugged and assembled into a whole.

As shown in FIG. 3, the structure of an end differential unit serving as a female unit comprises a female end module insulator 30, female signal contacts 35 are arranged in pairs in the female end module insulator 30 to form the above-mentioned differential signal pair, the end differential unit further comprises a female ground shielding member, the female ground shielding member includes a female full shielding sheath 33 correspondingly wrapped around the periphery of the female end module insulator 30, and the female signal contacts 35 extend out of the female end module insulator via openings at both ends of the female full shielding sheath 33. The extending end of each female signal contact is a wiring end, which is specifically a fish-eye structure 34 for connecting the corresponding printed board, and the other end is a signal overhung section 31. The female ground shielding member further comprises a ground overhung section 32 provided on one side of the full shielding sheath 33 and opposite to the corresponding female signal contact, and a corresponding ground fisheye is provided on the other side.

The above-mentioned signal overhung section 31 and the above-mentioned ground overhung section 32 cooperate to form the socket end of the female unit. For the female unit, the ground shielding member and the signal contact at the socket end of the female unit are arranged oppositely at an interval to form the plugging space for plugging the ground shielding member and the signal contact at the plug end of the corresponding male unit. In practice, the plugging space is formed through the cooperation of the signal overhung section and the ground overhung section, and the ground shielding member and the signal contact at the position form an elastic clamping structure, and the plugging space also serves as the clamping space of the elastic clamping structure.

On each female unit, the side surface of the signal contact at the socket end facing the plugging space is provided with a female differential contact portion, namely, the female differential contact portion is provided on the side surface of the signal overhung section facing the ground overhung section. On the female unit, the side surface of the ground shielding member at the socket end facing the plugging space is provided with a female shielding contact portion, i.e. the female shielding contact portion is provided on the side surface of the ground overhung section facing the signal overhung section.

Figure 4:
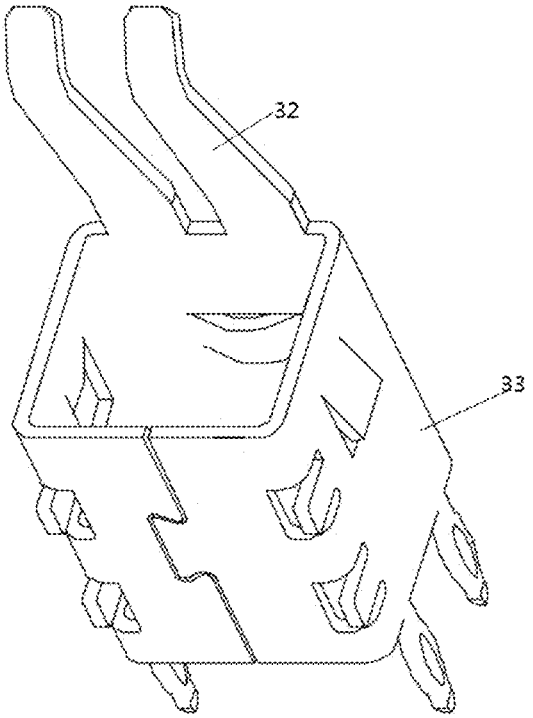
FIG. 4 is a schematic structural diagram of the female ground shielding member in FIG. 3.
Figure 5:
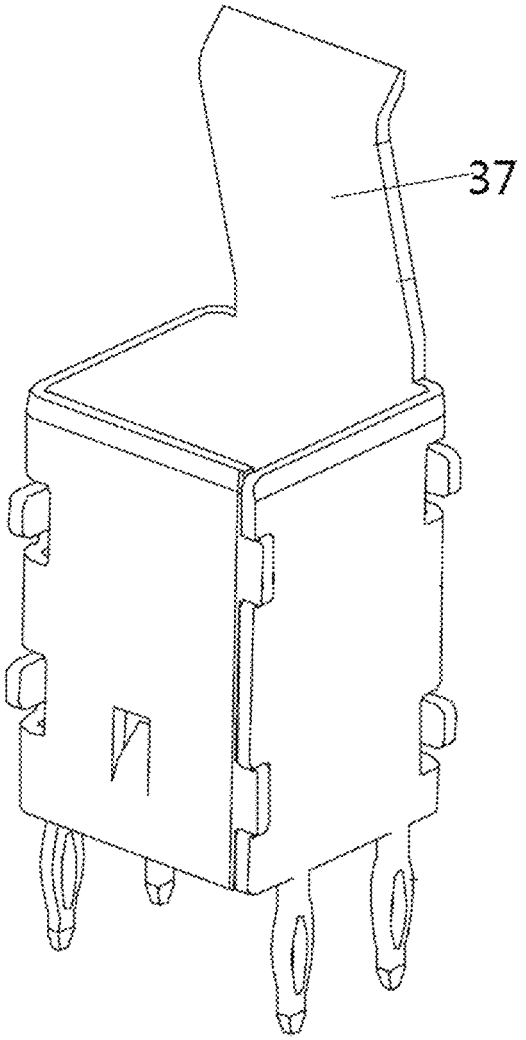
FIG. 5 is a schematic structural diagram of another type of female ground shielding member.

In practice, the female ground shielding member can be in various structures as shown in FIG. 4 and FIG. 5 which provide two different structures. FIG. 4 is the ground shielding member in FIG. 3, the ground overhung section extending from the full shielding sheath 33 at the female ground shielding member is a split type overhung arm, and the two split type overhung arms are substantially opposite to the two signal overhung sections. In FIG. 5, the ground overhung section extending from the full shielding sheath of the female ground shielding member is an integrated type overhung arm 37. Of course, in other embodiments, the female ground shielding member may also be in an elongated chip structure, i.e., the ground shielding housing structure wrapping a male end module insulator of the above embodiment is not included in the other embodiments.

The adapter differential units at the two ends of the adapter differential module serve as the male units for being correspondingly plugged into the end differential units serving as the female units.

Figure 7:
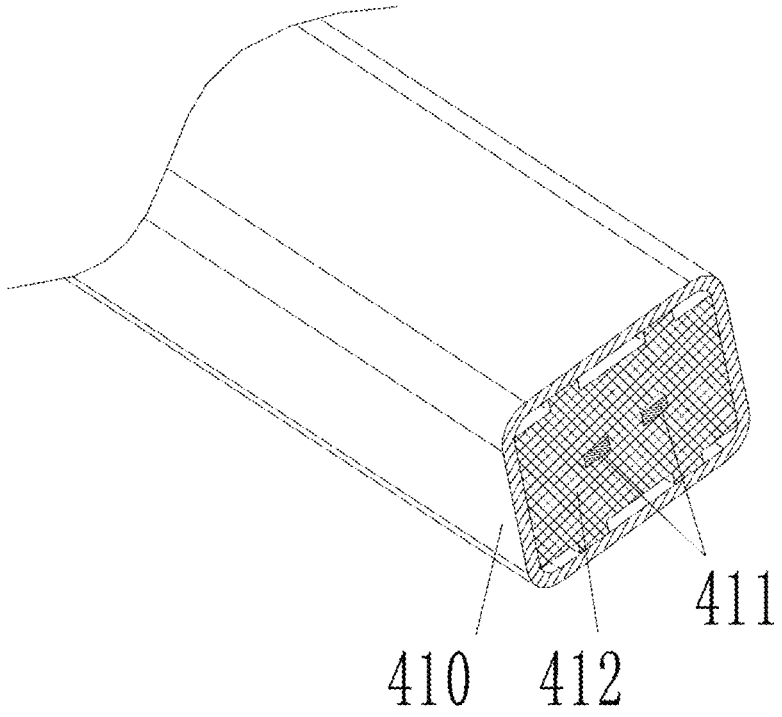
FIG. 7 is a schematic cross-sectional view of the adapter differential module in FIG. 6.
Figure 8:
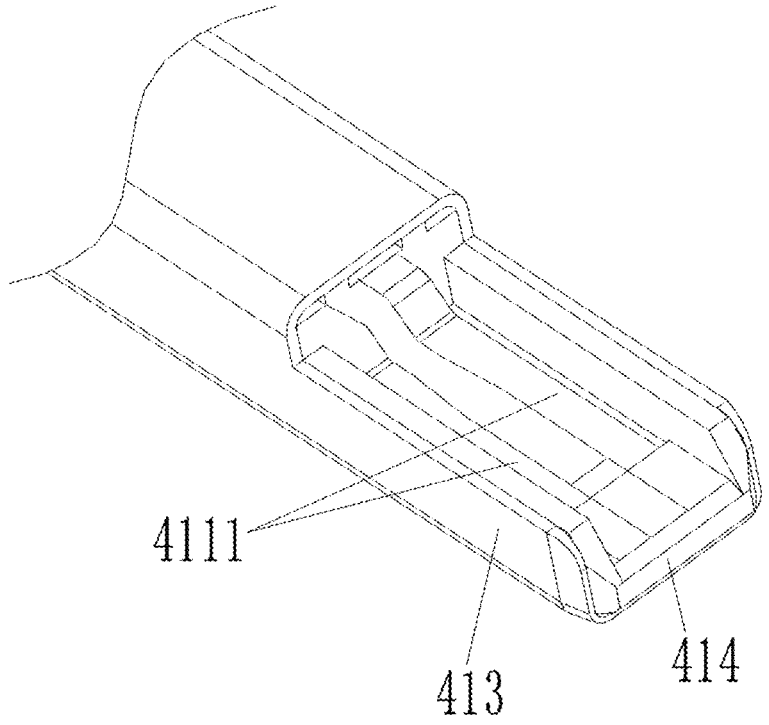
FIG. 8 is a schematic structural diagram of one end of the adapter differential module shown in FIG. 6.

The structure of the adapter differential module is shown as FIGS. 6, 7 and 8. The adapter differential module 41 comprises a unit insulator 412, two male signal contacts 411 forming corresponding differential signal pairs are mounted in the unit insulator 412, the male differential module further comprises a male ground shielding member, the male ground shielding member comprises a male full shielding sheath 410 wrapped around the periphery of the unit insulator 412, and two ends of each male signal contact 411 which extend out of the unit insulator serve as plug-in parts 4111 for plugging the adapted female unit. Of course, in other embodiments, the male ground shielding member may be in an elongated strip structure, that is, does not include the full shielding sheath for wrapping the male module insulator as described in the embodiment.

The two ends of the male full shielding sheath of the adapter differential module respectively integrally extend outwards to form a U-shaped shielding piece 413 serving as the ground shielding member of the corresponding male unit, correspondingly, the two ends of each male signal contact serve as signal contacts of a male end signal, the U-shaped shielding pieces 413 and the signal contacts cooperate to form the plug end of the male unit, and when the male unit is plugged and assembled into the corresponding female unit, the corresponding side surface of the ground shielding member at the plug end of the male unit is provided with a male shielding contact portion for elastically abutting against the corresponding female shielding contact portion, and the corresponding side surface of the signal contact at the plug end of the male unit is provided with an end differential contact portion for elastically abutting against the corresponding female signal contact portion.

Furthermore, in order to improve the elastic abutting force between the male units and the female units, a corresponding support structure is provided on each male unit and corresponding to the signal contact and the ground shielding member. Specifically, the unit insulator 412 of the male unit is provided with an insulating support portion 414 between the ground shielding member and the signal contact at the plug end of the male unit, and the ground shielding member and the signal contact at the plug end are disposed on the insulating support portion to provide effective support, thereby improving the lateral pressing force during elastic abutment.

Furthermore, in order to improve the shielding effect, on each male unit, the corresponding signal contact at the plug end is actually located inside the U-shaped shielding piece 413, whereas the insulating support portion 414 is filled in the inner groove of the U-shaped shielding piece 413 to expose the side face of the corresponding signal contact facing the notch of the U-shaped shielding piece, and correspondingly, the male differential contact portion is provided on the exposed side face of the corresponding signal contact portion.

Figure 9:
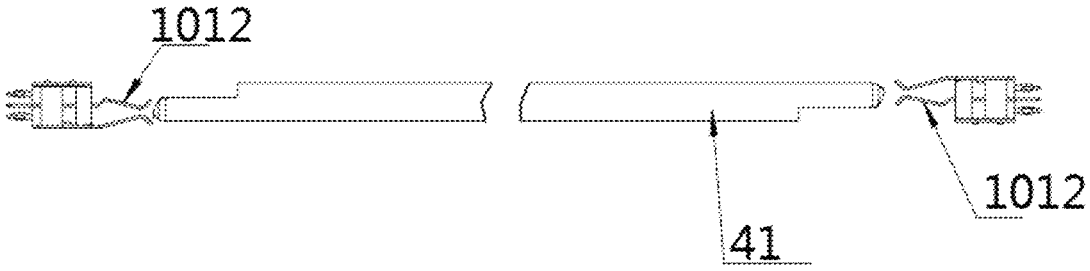
FIG. 9 is a schematic diagram of plugging assembly of two end differential units and one adapter differential module in the connector assembly shown in FIG. 1.
Figure 10:
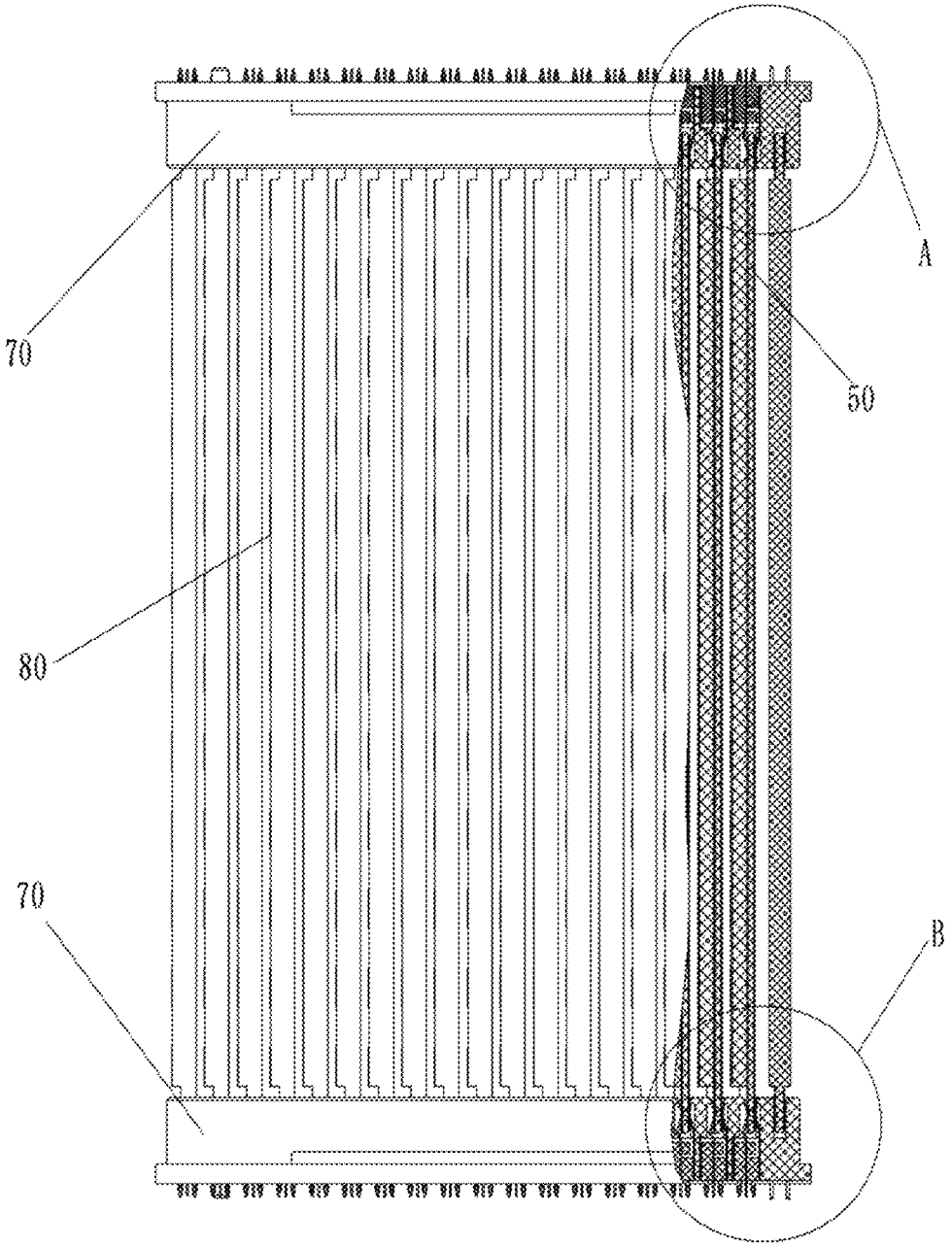
FIG. 10 is a schematic structural diagram of Embodiment 2 of the connector assembly provided by the present invention.
Figure 11:
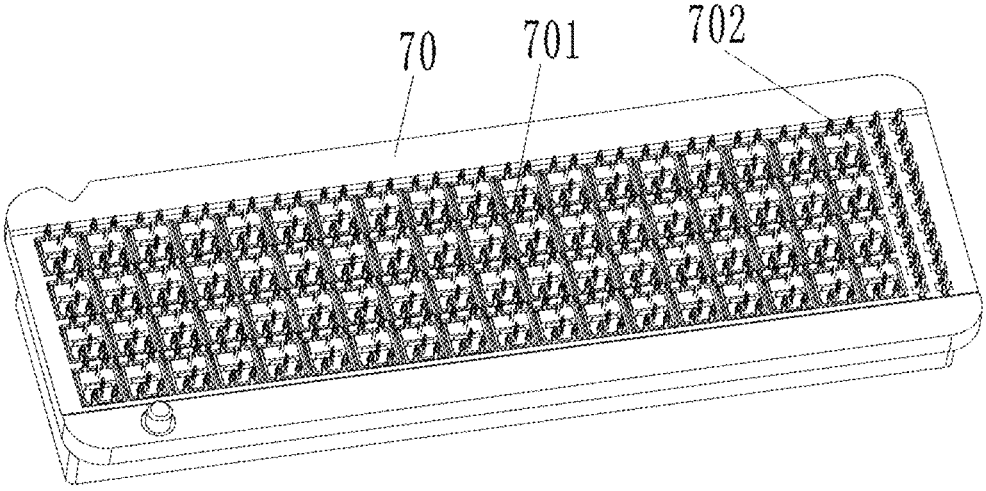
FIG. 11 is a schematic structural view of the end-connector of FIG. 10.
Figure 12:
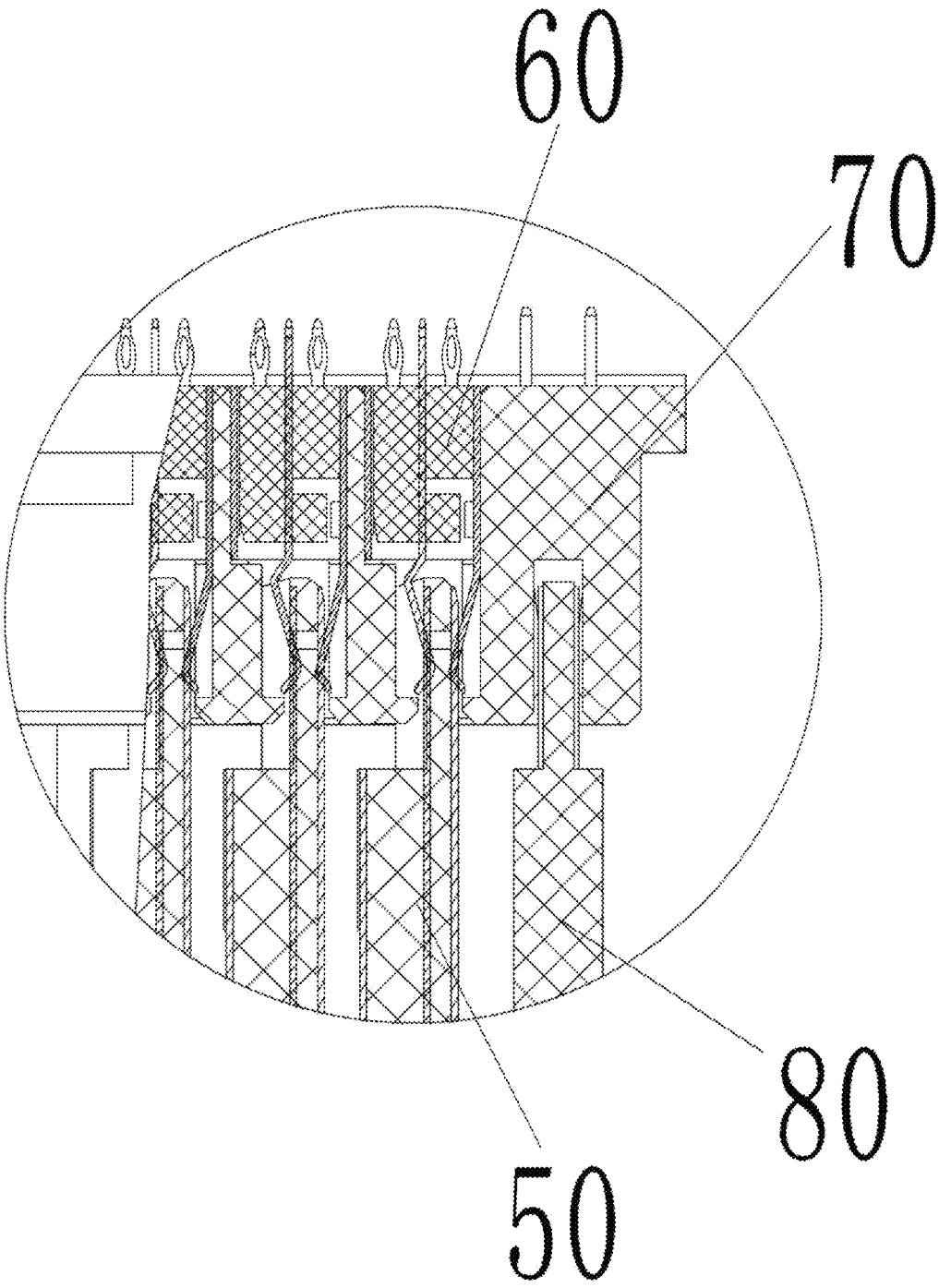
FIG. 12 is an enlarged view of part Ain FIG. 10.
Figure 13:
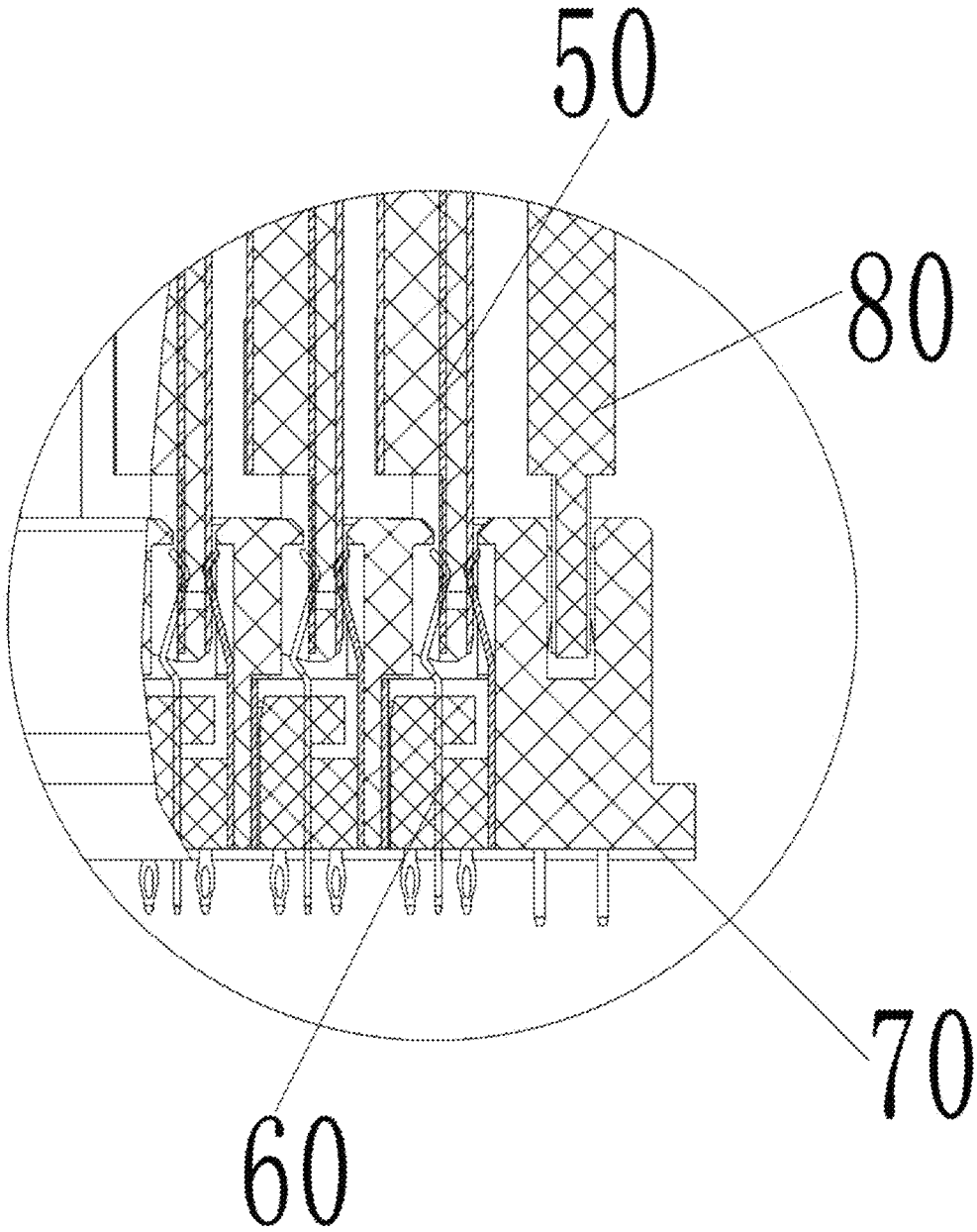
FIG. 13 is an enlarged view of part B in FIG. 10.

As shown in FIG. 9, in the present embodiment, the two end-connectors are the same in structure, so that under the condition that normal assembly requirements of a hybrid connector are met, the number of types of the end-connectors can be reduced. At this time, because the ground shielding member and the signal contact at the socket end of each female unit are actually arranged in the front-rear direction relative to the above-mentioned left-right direction, in order to ensure normal assembly, the male signal contact portions of the adapter differential units at the two ends of the adapter differential module 41 face opposite directions, and likewise, the female signal contact portions of the end differential units 1012 of the two end-connectors also face opposite directions, that is, the female signal contact portion of the end differential unit of one end-connector is arranged facing forward, and the female signal contact portion of the end differential unit of the other end-connector is arranged facing backward, so as to form a different-side signal arrangement manner.

In the embodiment, the corresponding connector housings of both the end-connectors and the adapter connector are respectively provided with a plurality of module channels so as to position and mount the corresponding functional modules, which, for high-speed differential areas, are corresponding differential units or modules, and for low-speed areas, are corresponding low-speed and power supply signal modules.

When the end-connectors and the adapter connector are adapted and plugged, the plug end of each male unit is correspondingly plugged into the plugging space of the socket end of the corresponding female unit, so that the corresponding signal contacts and the corresponding shielding contact pieces of the two units adapted in the plugging position bear interaction forces at both sides, and even during application on occasions with vibration or certain plugging offset, the stability of plugging contact can be effectively improved and the contact performance be more reliable.

In the present embodiment, the two end-connectors are the same in structure, so that the orientation of the differential contact portions of the signal contacts of the adapter differential units in the adapter connector should be taken into notice, and if the two end-connectors are in different structures and of different types, the adapter differential module structure of the adapter connector may be configured according to actual requirements.

Furthermore, in the embodiment, the adapter differential units at the two ends of the adapter differential module of the adapter connector are both male units, while in other embodiments, one end of the adapter differential units at the two ends can be a female unit structure, and the other end can be a corresponding male unit structure, in the case, the end differential unit on one end-connector needs to be a corresponding male unit structure, and the other end is a corresponding female unit structure. In addition, in order to ensure that the two adapter differential units of the adapter differential module are female units, both the two end differential units can be the male unit structures.

Embodiment 2 of the connector assembly provided by the present invention is:

The main difference of Embodiment 2 from Embodiment 1 is that the connector assembly is in a structure as shown in FIGS. 10 to 15, and the connector assembly also includes an intermediate adapter connector 80 and two corresponding end-connectors 70 at two ends, and each end-connector 70 also comprises a high-speed differential area 701 and a low-speed area 702 as a functional area which are distributed in the left-right direction.

Correspondingly, two ends of the adapter differential module in the adapter connector are correspondingly plugged into the end differential units 60 of the end-connectors of the corresponding end.

Figure 14:
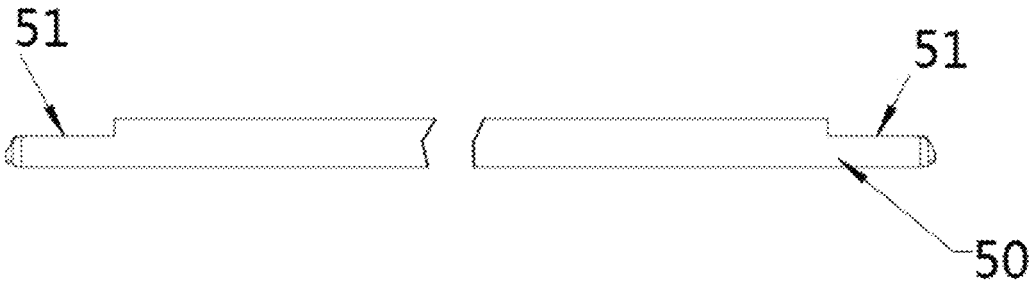
FIG. 14 is a schematic structural diagram of the adapter differential module of the adapter connector in FIG. 10.
Figure 15:
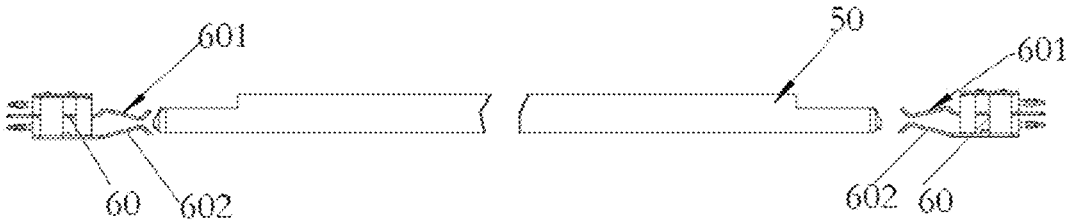
FIG. 15 is a schematic diagram of plugging assembly of two end differential units and one adapter differential module in the connector assembly shown in FIG. 10.

It is to be noted that the ground shielding member 602 and the signal contact 601 at the end differential unit 60 of each end-connector 70, which serves as a female unit, are also arranged oppositely in the left-right direction to form a same-side signal arrangement manner. Correspondingly, as shown in FIG. 14 and FIG. 15, the differential contact portions of the signal contact of the adapter differential units 51 at the two ends of the adapter differential module 50 are arranged facing the same direction, namely in the same-side signal arrangement manner.

It should be noted that the two end-connectors in the Embodiment 1 are the same in structure, and the two end-connectors in the second embodiment are also the same in structure, which is not only the same in the structures of the plug-in parts of the two end-connectors for adapting with the adapter connector, but also the same in the structures of other parts included, so that blind plugging can be fully realized. The plug-in parts of the end-connectors include not only the plug-in parts on the corresponding connector housings, but also the corresponding plug-in parts on the corresponding contact members.

Figure 16:
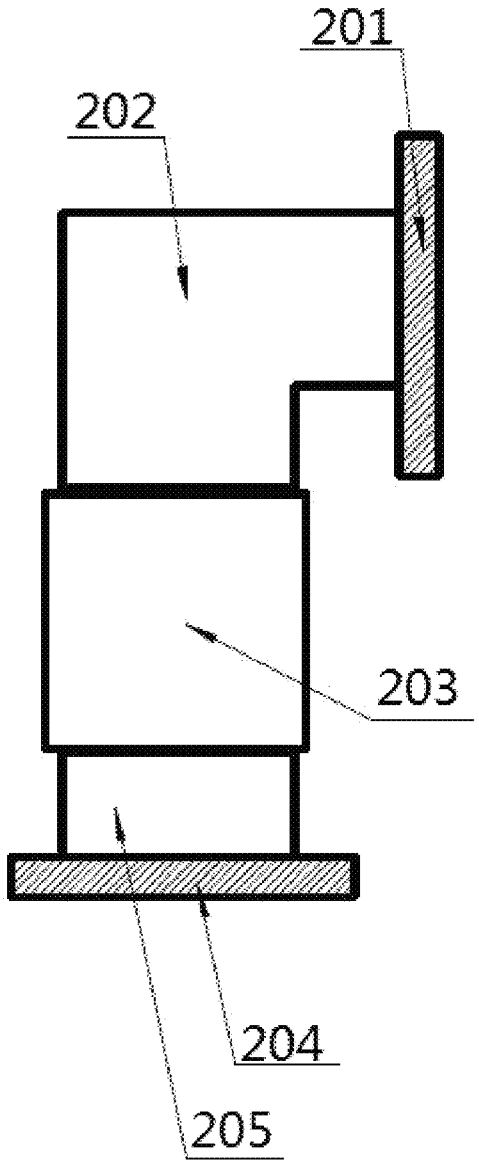
FIG. 16 is a schematic structural diagram of Embodiment 3 of the connector assembly provided by the present invention.

Embodiment 3 of the connector assembly provided by the present invention is:

The structure of the connector assembly is shown in FIG. 16, and the difference of Embodiment 3 from Embodiment 1 is that: the connector assembly is in a backplane structure, the adapter connector is also a straight adapter connector 203, but one of the two end-connectors is a straight board end-connector 205 and the other is a bent board end-connector 202, and one the two printed boards is a backplane printed board 204 arranged at the corresponding end of the straight board end-connector, the other is a daughter printed board 201 arranged at the corresponding end of the bent board end-connector, and the two printed boards are arranged orthogonally.

Furthermore, it should be noted that the plug-in part of the bent board end-connector 202 and the plug-in part of the straight board end-connector 205 are the same structure in and thus can realize blind plugging with the corresponding straight adapter connector 203.

Figure 17:
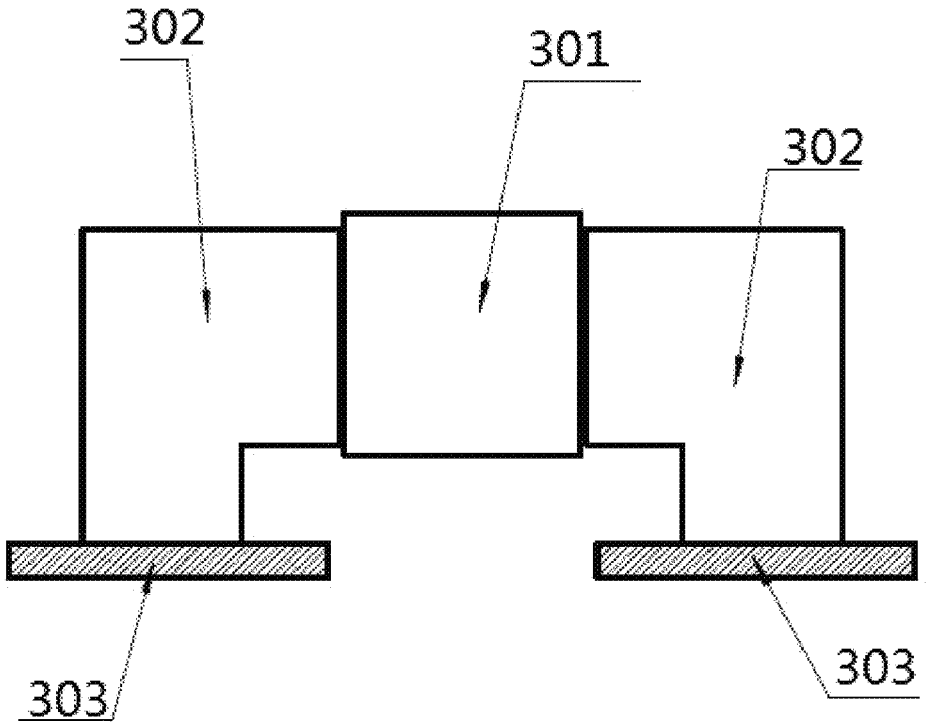
FIG. 17 is a schematic structural diagram of Embodiment 4 of the connector assembly provided by the present invention.

Embodiment 4 of the connector assembly provided by the present invention is:

The structure of the connector assembly is as shown in FIG. 17, and the difference of Embodiment 4 from Embodiment 1 is that: the connector assembly is in a parallel board structure, the adapter connector is also a straight adapter connector 301, but both the end-connectors are bent board end-connectors 302, and one ends of the two bent board end-connectors away from the adapter connector are welded with printed boards 303 which are arranged in parallel. The connector assembly described above can be applied to various types of printed boards and end-connectors and accordingly be wide in application range.

Furthermore, it should be noted that the plug-in parts of the two bent board end-connectors 302 are the same in structure and thus can realize blind plugging with the corresponding straight adapter connector 301.

Figure 18:
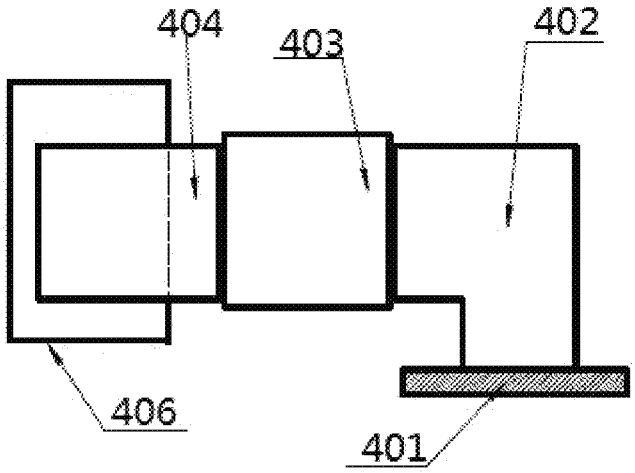
FIG. 18 is a schematic structural diagram of Embodiment 5 of the connector assembly provided by the present invention.
Figure 19:
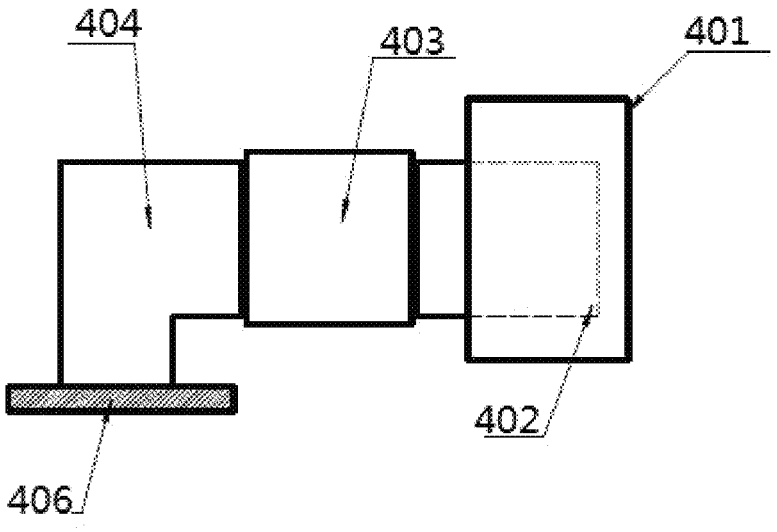
FIG. 19 is a top view of the connector assembly shown in FIG. 18.

Embodiment 5 of the connector assembly provided by the present invention is:

The structure of the connector assembly is shown in FIG. 18 and FIG. 19, and the difference of Embodiment 5 from Embodiment 1 is that: the connector assembly is in an orthogonal board structure, the adapter connector is also a straight adapter connector 403, and the two end-connectors are all bent board end-connectors including a first bent board end-connector 404 and a second bent board end-connector 402; one ends of the two bent board end-connectors away from the adapter connector are respectively welded with a printed board, i.e., a first printed board 406 and a second printed board 402; the first printed board and the second printed board are arranged orthogonally so that the connector assembly can be integrally in the orthogonal structure.

Furthermore, it should be noted that the plug-in part of the first bent board end-connector 404 and the plug-in part of the second bent board end-connector 402 are the same in structure and thus can realize blind plugging with the corresponding straight adapter connector 403.

In the above-described embodiment, the corresponding ends of the end-connectors away from the adapter connector are respectively provided with a printed board, while in other embodiments, other conductive connection manners may be provided.

In the above-described embodiment, each male differential contact portion elastically abuts against the corresponding female differential contact portion, and each male shielding contact portion elastically abuts against the corresponding female shielding contact portion, so that the contact effect can be improved through the elastic force. In other embodiments, each male differential contact portion can electrically abut against the corresponding female differential contact portion, and each male shielding contact portion can electrically abut against the corresponding female shielding contact portion as long as corresponding side-surface conductive contact is achieved.

The invention claimed is:

1. An electrical connector adapter for connecting between two circuit board connectors, comprising an adapter connector and two end-connectors correspondingly plugged into the upper and lower ends of the adapter connector, wherein each of the end-connectors and adapter connector is provided with a high-speed differential area and a functional area sequentially arranged in a left-right direction, wherein each of the end-connectors and adapter connector has a cross-section perpendicular to the signal transmission direction, and the cross-section is in the shape of a rectangle, the left-right direction thereof corresponds to the width direction of the rectangle, and correspondingly, the front-rear direction perpendicular to the left-right direction corresponds to the length direction of the rectangle;

the high-speed differential area of the end-connector is provided with an end differential unit, the high-speed differential area of the adapter connector is provided with an adapter differential module, two ends of the adapter differential module are respectively provided with an adapter differential unit which is plugged into the end differential unit of the corresponding end-connector to connect the end differential units on both sides, and the end differential unit of each end-connector and the adapter differential unit of the corresponding end of the adapter connector correspondingly form a differential plug-in group;

each end differential unit and the corresponding adapter differential unit respectively comprise a signal contact forming a differential signal pair and a ground shielding member provided corresponding to the differential signal pair;

the plug-in parts of the two end-connectors, which are adapted with the adapter connectors, are the same in structure;

furthermore, of the end differential unit and the corresponding adapter differential unit of each differential plug-in group, one is a male unit and the other is a female unit, and the plug end of the male unit and the socket end of the female unit are in corresponding plug-in fit;

the ground shielding member and the signal contact at the socket end of each female unit are arranged oppositely at an interval to form a plugging space for plugging the ground shielding member and the signal contact at the plug end of the corresponding male unit;

on each female unit, a side surface of the signal contact at the socket end facing the plugging space is provided with a female differential contact portion, and on the corresponding male unit, the corresponding side surface of the signal contact at the plug end is provided with a male differential contact portion for correspondingly abutting against the female differential contact portion;

on each female unit, a side surface of the ground shielding member at the socket end facing the plugging space is provided with a female shielding contact portion, and on the corresponding male unit, the corresponding side surface of the ground shielding member at the plug end is provided with a male shielding contact portion for correspondingly abutting against the female shielding contact portion;

the ground shielding member and the signal contact at the socket end of each female unit are arranged oppositely in the left-right direction, and the differential contact portions of the signal contacts of the adapter differential units at the two ends of the adapter differential module face the same direction;

wherein, the adapter differential units at the two ends of the adapter differential module are the male units, the adapter differential module comprises an intermediate differential contact member, the two ends of the differential contact member correspondingly form the signal contact of the two male units, the adapter differential module further comprises a full shielding sheath which is wrapped in an insulating manner around the periphery of the differential contact member, and two ends of the full shielding sheath are integrally extended to ground shielding pieces to form the ground shielding members of the two male units.

2. The electrical connector adapter for connecting between two circuit board connectors according to claim 1, characterized in that the two end-connectors are the same in structure.

3. The electrical connector adapter for connecting between two circuit board connectors according to claim 1, characterized in that each male differential contact portion elastically abuts against the corresponding female differential contact portion, and each male shielding contact portion elastically abuts against the corresponding female shielding contact portion.

4. The electrical connector adapter for connecting between two circuit board connectors according to claim 3, characterized in that each male unit further comprises a unit insulator having an insulating support portion located between the ground shielding member and the signal contact at the plug end, and the ground shielding member and the signal contact at the plug end are disposed on the insulating support portion, or the insulating support portion is provided with a support surface for contacting and supporting the ground shielding member and the signal contact at the plug end.

5. The electrical connector adapter for connecting between two circuit board connectors according to claim 4, characterized in that the ground shielding member at the plug end of the male unit is a U-shaped shielding piece, the corresponding signal contact at the plug end of the male unit is disposed in the U-shaped shielding piece, the insulating support portion is filled in the inner groove of the U-shaped shielding piece to expose the side surface of the corresponding signal contact facing the notch of the U-shaped shielding piece, and the male differential contact portion is provided on the exposed side surface of the corresponding signal contact.

6. The electrical connector adapter for connecting between two circuit board connectors according to claim 1, characterized in that one end of each end-connector away from the adapter connector is welded with a printed board, the adapter connector is a straight adapter connector, and the two printed boards and the two end-connectors adopt one of the following manners:

(1) both the two end-connectors are straight board end-connectors, and the two printed boards are arranged in parallel;

(2) one of the two end-connectors is a straight board end-connector, the other is a bent board end-connector, and the two printed boards are arranged orthogonally;

(3) both the two end-connectors are bent board end-connectors, and the two printed boards are arranged in parallel; and (4) both the two end-connectors are bent board end-connectors, and the two printed boards are arranged orthogonally.

7. An electrical connector adapter for connecting between two circuit board connectors, comprising an adapter connector and two end-connectors correspondingly plugged into the upper and lower ends of the adapter connector, wherein each of the end-connectors and adapter connector is provided with a high-speed differential area and a functional area sequentially arranged in a left-right direction, wherein each of the end-connectors and adapter connector has a cross-section perpendicular to the signal transmission direction, and the cross-section is in the shape of a rectangle, the left-right direction thereof corresponds to the width direction of the rectangle, and correspondingly, the front-rear direction perpendicular to the left-right direction corresponds to the length direction of the rectangle;

the high-speed differential area of each end-connector is provided with an end differential unit, the high-speed differential area of the adapter connector is provided with an adapter differential module, two ends of the adapter differential module are respectively provided with an adapter differential unit which is plugged into the end differential unit of the corresponding end-connector to connect the end differential units on both sides, and the end differential unit of each end-connector and the adapter differential unit of the corresponding end of the adapter connector correspondingly form a differential plug-in group;

each end differential unit and the corresponding adapter differential unit respectively comprises a signal contact forming a differential signal pair and a ground shielding member provided corresponding to the differential signal pair;

the plug-in parts of the two end-connectors, which are adapted with the adapter connectors, are the same in structure;

furthermore, of the end differential unit and the corresponding adapter differential units of each differential plug-in group, one is a male unit and the other is a female unit, and the plug end of the male unit and the socket end of the female unit are in corresponding plug-in fit;

the ground shielding member and the signal contact at the socket end of each female unit are arranged oppositely at an interval to form a plugging space for plugging the ground shielding member and the signal contact at the plug end of the corresponding male unit;

on each female unit, a side surface of the signal contact at the socket end facing the plugging space is provided with a female differential contact portion, and on the corresponding male unit, the corresponding side surface of the signal contact at the plug end is provided with a male differential contact portion for correspondingly abutting against the female differential contact portion;

on each female unit, a side surface of the ground shielding member at the socket end facing the plugging space is provided with a female shielding contact portion, and on the corresponding male unit, the corresponding side surface of the ground shielding member at the plug end is provided with a male shielding contact portion for correspondingly abutting against the female shielding contact portion;

the ground shielding member and the signal contact at the socket end of each female unit are arranged in a front-rear direction relative to the left-right direction, and the differential contact portions of the signal contacts of the adapter differential units at the two ends of the adapter differential module face opposite directions;

wherein, the adapter differential units at the two ends of the adapter differential module are the male units, the adapter differential module comprises an intermediate differential contact member, the two ends of the differential contact member correspondingly form the signal contact of the two male units, the adapter differential module further comprises a full shielding sheath which is wrapped in an insulating manner around the periphery of the differential contact member, and the two ends of the full shielding sheath are integrally extended to ground shielding pieces to form the ground shielding members of the two male units.

8. The electrical connector adapter for connecting between two circuit board connectors according to claim 7, characterized in that the two end-connectors are the same in structure.

9. The electrical connector adapter for connecting between two circuit board connectors according to claim 7, characterized in that each male differential contact portion elastically abuts against the corresponding female differential contact portion, and each male shielding contact portion elastically abuts against the corresponding female shielding contact portion.

10. The electrical connector adapter for connecting between two circuit board connectors according to claim 9, characterized in that each male unit further comprises a unit insulator having an insulating support portion located between the ground shielding member and the signal contact at the plug end, and the ground shielding member and the signal contact at the plug end are disposed on the insulating support portion, or the insulating support portion is provided with a support surface for contacting and supporting the ground shielding member and the signal contact at the plug end.

11. The electrical connector adapter for connecting between two circuit board connectors according to claim 10, characterized in that the ground shielding member at the plug end of the male unit is a U-shaped shielding piece, the corresponding signal contact at the plug end of the male unit is disposed in the U-shaped shielding piece, the insulating support portion is filled in the inner groove of the U-shaped shielding piece to expose the side surface of the corresponding signal contact facing the notch of the U-shaped shielding piece, and the male differential contact portion is provided on the exposed side surface of the corresponding signal contact.

12. The electrical connector adapter for connecting between two circuit board connectors according to claim 7, characterized in that one end of each end-connector away from the adapter connector is welded with a printed board, the adapter connector is a straight adapter connector, and the two printed boards and the two end-connectors adopt one of the following manners:

(1) both the two end-connectors are straight board end-connectors, and the two printed boards are arranged in parallel;

(2) one of the two end-connectors is a straight board end-connector and the other is a bent board end-connector, and the two printed boards are arranged orthogonally;

(3) both the two end-connectors are bent board end-connectors, and the two printed boards are arranged in parallel; and (4) both the two end-connectors are bent board end-connectors, and the two printed boards are arranged orthogonally.

* * * * *